US010683150B2

(12) United States Patent
Dinh et al.

(10) Patent No.: US 10,683,150 B2
(45) Date of Patent: Jun. 16, 2020

(54) HIGH PERFORMANCE, DUAL MATERIALS CABLE-TIE HEAD

(71) Applicants: THOMAS & BETTS INTERNATIONAL LLC, Wilmington, DE (US); Cong Thanh Dinh, Collierville, TN (US); Yan Gao, Memphis, TN (US)

(72) Inventors: Cong T. Dinh, Collierville, TN (US); Yan Gao, Memphis, TN (US)

(73) Assignee: Thomas & Betts International LLC, Wilmington, DE (US)

( * ) Notice: Subject to any disclaimer, the term of this patent is extended or adjusted under 35 U.S.C. 154(b) by 105 days.

(21) Appl. No.: 16/067,289

(22) PCT Filed: Jan. 13, 2017

(86) PCT No.: PCT/US2017/013335
§ 371 (c)(1),
(2) Date: Jun. 29, 2018

(87) PCT Pub. No.: WO2017/123869
PCT Pub. Date: Jul. 20, 2017

(65) Prior Publication Data

US 2019/0009959 A1 Jan. 10, 2019

Related U.S. Application Data

(60) Provisional application No. 62/278,146, filed on Jan. 13, 2016.

(51) Int. Cl.
*B65D 63/10* (2006.01)

(52) U.S. Cl.
CPC ..... *B65D 63/1081* (2013.01); *B65D 63/1063* (2013.01); *B65D 63/1072* (2013.01); *B65D 2563/103* (2013.01)

(58) Field of Classification Search
CPC ..... B65D 2563/103; B65D 63/1063; B65D 63/1072; B65D 63/1081
See application file for complete search history.

(56) References Cited

U.S. PATENT DOCUMENTS 5,377,388 A 1/1995 DeBever
5,924,171 A 7/1999 Sorensen et al.
(Continued)

FOREIGN PATENT DOCUMENTS

GB 2372282 8/2002

OTHER PUBLICATIONS

Search Report and Written Opinion, PCT Appln. No. PCT/U17/13335, 11 pgs. dated Apr. 6, 2017, dated Apr. 6, 2017.
(Continued)

*Primary Examiner* — Robert Sandy
*Assistant Examiner* — David M Upchurch
(74) *Attorney, Agent, or Firm* — Taft Stettinius & Hollister LLP; J. Bruce Schelkopf

(57) ABSTRACT

A dual material cable tie includes a tail on a first end, a head on a second end, and an elongated strap extending therebetween. The strap and tail are substantially flat and formed from a first material. The tail can have teeth/ridges on one or both of the surfaces that extend outwardly from the surface(s). The head has a first portion, a second portion and a passage extending from a first end to a second end that receives the tail. A pawl is located in the passage and the second portion includes an exterior surface. The first portion of the head is made from a first material and the second portion is made from a second material that can be stiffer than the first material and the hardness of the second material can be the same or greater than the first material.

20 Claims, 6 Drawing Sheets

(56) References Cited

U.S. PATENT DOCUMENTS

| | | | | |
|---|---|---|---|---|
| 6,681,451 | B1 * | 1/2004 | Adams | B65D 63/1027 24/16 PB |
| 6,863,855 | B2 | 3/2005 | Shilale | |
| 8,479,361 | B2 | 7/2013 | Every | |
| 2002/0071715 | A1 | 6/2002 | Geiger | |
| 2002/0170153 | A1 * | 11/2002 | Brownlee | B65D 63/1036 24/16 PB |
| 2005/0050691 | A1 | 3/2005 | Schroder et al. | |
| 2006/0242800 | A1 | 11/2006 | Pettersson | |
| 2010/0146742 | A1 | 6/2010 | Every | |
| 2012/0233818 | A1 * | 9/2012 | Newth | B65D 63/1027 24/16 R |
| 2013/0031751 | A1 * | 2/2013 | Bartholomew | B65D 63/1045 24/16 PB |
| 2013/0081232 | A1 * | 4/2013 | Magno, Jr. | B65D 63/1063 24/16 PB |
| 2013/0298353 | A1 * | 11/2013 | Drane | B65D 63/1063 24/16 PB |
| 2015/0266637 | A1 | 9/2015 | Drane et al. | |
| 2018/0362231 | A1 * | 12/2018 | MacNaughton | B65D 63/1072 |

OTHER PUBLICATIONS

Extended EP Search Report, EP Appln. No. 17739000.2, dated Jul. 16, 2019, 8 pgs, dated Jul 16, 2019.

Canadian Office Action, Canadian Application No. 3,011,1042,936,440, dated May 13, 2019, 2pgs dated May 13, 2019.

* cited by examiner

HIGH PERFORMANCE, DUAL MATERIALS CABLE-TIE HEAD

This application claims priority based on PCT Application No. PCT/US2017/013335, filed on Jan. 13, 2017, which claims priority based on U.S. provisional application Ser. No. 62/278,146, filed on Jan. 13, 2016, which is incorporated herein in its entirety.

FIELD OF THE INVENTION

The present invention relates generally to a cable tie, and more specifically, to a cable tie that has a head formed from two polymer materials, each having a different flexural modulus and hardness, with the stiffer and/or harder material on the outside of the head.

BACKGROUND OF INVENTION

Cable ties are well known devices used to bundle or secure a group of articles such as electrical wires or cables. U.S. Pat. No. 3,102,311 to Martin et al. is an early example of ties used for such purposes. Cable ties 910 of conventional construction include a cable tie head 912, a longitudinal strap 916 extending from the head and a tail 914 at the opposite end of the strap 916 (see FIG. 1). The strap 916 is wrapped around a bundle of articles and the tail 914 is inserted through an aperture or passage in the head 912. The head 912 of the cable tie 910 typically includes a locking element in the passage which engages the strap 916 after it is inserted into the passage. Once the tail 914 is pulled through the passage, the locking element secures the strap 916 in the head 912. (See FIG. 2)

Advances in cable tie construction have taken many forms and shapes. Many of these advances have been in the area of the locking element carried in the cable tie head to secure the strap therein. The art has seen the use of flexible locking elements which are integrally molded with the head. However, a recognized weakness in many integrally molded cable tie designs is the non-rigid nature of the head. Typically, cable ties—the tail and head—are made of the same material and they are designed to be flexible so that they can be wrapped around an object or used to secure two or more objects together. Because of this, non-rigid materials used to make cable ties and the heads, including the locking element, have a degree of flexibility. These flexible heads may not tightly grip the tail and the tail can be pulled out of the head by turning and twisting.

Thus, there exists a need to provide a cable tie with a head that is more rigid and does not allow the tail to be easily pulled out after it is secured in the head.

SUMMARY OF THE INVENTION

In accordance with the present invention, a dual material cable tie comprising, consisting of or consisting essentially of a tail on a first end, a head on a second end, and an elongated strap is provided. The strap and tail are substantially flat and formed from a first material. The strap extends between the tail and the head. The tail and/or strap can have teeth/ridges on one or both of the surfaces that extend outwardly from the surface(s). The head has a first portion, a second portion and a passage extending from a first end to a second end that receives the tail. A pawl is located in the passage and the second portion includes an exterior surface.

The first portion of the head is made from a first material and the second portion is made from a second material. The first material has a maximum durometer and the second material has a minimum durometer that is at least 5, preferably at least 10 and most preferably at least 15 on the Shore D scale greater than the maximum durometer of the first material. The stiffness of a material is measured by its flexural modulus. The first material has a maximum flexural modulus of 1.7 GPa, the second material has a minimum flexural modulus of 10 GPa and most preferably 15 GPa or higher. The second material can be stiffer than the first material and the hardness of the second material can be the same or greater than the first material.

The passage is defined by first and second sides that extend between the first and second ends; preferably, the pawl extends from the first side. The second side of the passage can have one or more teeth extending into the passage. Preferably, these teeth are formed from the second material and extend obliquely from the second side of the passage towards the second end of the head. The tail can be substantially flat and integrally formed with the strap and have opposing first and second surfaces. Each surface of the tail and strap can have a plurality of teeth extending outwardly. Preferably, the teeth on the opposing surfaces of the tail/strap extend obliquely away from the first end of the cable tie. The tail end of the cable tie can pass freely in the direction between the first end and the second end of the head. However, the teeth in the passage engage the teeth on the opposing surfaces of the tail to prevent the tail of the cable tie from passing freely in the direction between the second end and the first end of the head.

Preferably, the tail, strap and first portion of the head are integrally formed by a first process and the second portion of the head is formed by a second process. The second process can be an over-molding process. The first and second processes can also be formed independently. The cable tie head is then assembled by inserting the first portion into the second portion.

BRIEF DESCRIPTION OF THE FIGURES

The preferred embodiments of the high performance, dual material cable tie of the present invention, as well as other objects, features and advantages of this invention, will be apparent from the accompanying drawings wherein.

DETAILED DESCRIPTION OF THE INVENTION

Figure 1:
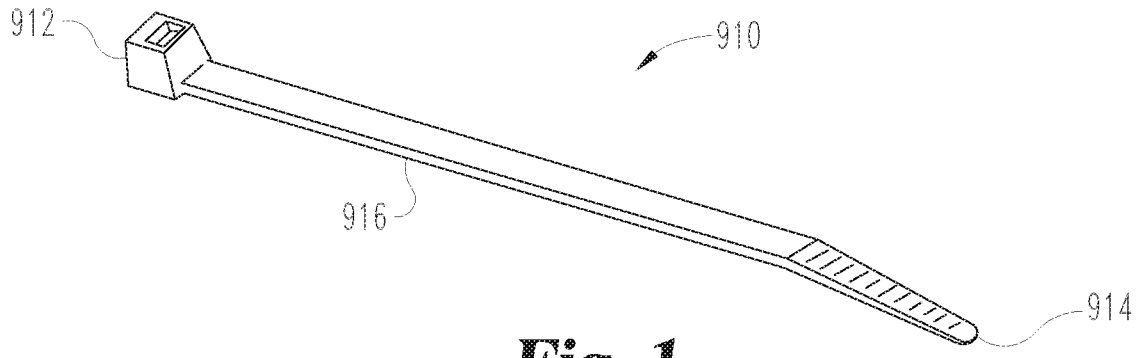
Fig. 1 (Prior Art)
FIG. 1 is a prior art cable tie in an unlocked configuration.

The present invention is a cable tie that has a cable tie head formed of dual materials. This is in contrast to standard cable ties that are typically molded using a single material for both the body (tail and strap) and the head. The dual material cable tie head displays increased strength over heads of cable ties made from a single material. The first material is used to form the cable tie tail, strap and part of the head, including the flexible pawl. The second stiffer and/or harder material is used to form the exterior portion of the head. Preferably, the two materials are injection molded plastic and the stiffer and/or harder second material can be formed using an over-molding process. When the tail end of the cable tie is inserted into the head, the ridges on the tail end are engaged by the pawl(s) in the head. If the user tries to remove the tail end from the head, the pawl(s) keep the tail secured in the head. However, as the force is increased by the user, the pawl(s) is pushed away from the tail. The shell of hard material on the exterior of the head resists the outward movement of the pawl(s) and makes it more difficult for the tail of the cable tie to be withdrawn from the head.

In a preferred embodiment, the portion of the strap body that forms the tail has teeth (also referred to herein as ridges) on one or both sides. The tail is inserted into a passage that extends through the head. The passage has a pawl on one side that extends from the wall at an angle of less than 90 degrees in the direction that the tail moves through the passage. The pawl allows the tail to move through the passage in one direction but prevents the tail from moving through the passage in the opposing direction by engaging the teeth/ridges in the tail with the distal end(s) of the pawl. Also, the stiffer and/or harder material of the head can include one or more fixed teeth extending from the side opposite the flexible pawl to increase the holding strength. The pawl engages the teeth/ridges on one side of the tail while the fixed teeth, which are preferably formed from the stiffer and/or harder material, engage the teeth/ridges on the other side of the tail.

As used herein, the term "cable tie" refers to any type of plastic tie that includes an elongated strap with a tail on one end and a locking head on the opposing end that receives and secures the tail to form a closed loop. The tail is the portion of the strap that has teeth/ridges for engaging the locking mechanism in the head of the cable tie. Examples of such ties are found in U.S. Pat. No. 3,186,047 to Schwester et al.; U.S. Pat. Nos. 5,621,949 and 5,630,252 to Wells; U.S. Pat. Nos. 6,076,235; 6,128,809; and 6,185,791 to Khokhar; U.S. Pat. No. 7,017,237 to Magno, Jr. et al.; and U.S. Des. 205,940 to Miller; all of which are incorporated herein in their entirety. However, the examples in these patents are not intended to limit the construction of the term "cable tie" as used herein in any way.

As used herein, the term "over-molding" refers to the process of adding an additional layer of material over an already existing piece or part with or without the use of an intermediate adhesive layer. Typically, the first material, sometimes referred to as the substrate, is partially or fully covered by subsequent materials ("over-mold materials") during the manufacturing process. In most over-molding processes, the substrate material or part is placed into an injection molding tool at which point the over-mold material is shot into, onto, or around the substrate. When the over-mold material cures or solidifies, the two materials become joined together as a single part.

As used herein, the term "hardness" refers to the resistance of a material to surface penetration. Harder materials are characterized by their resistance to wear and decreased flexibility. The durometer of a material is a measure of its relative hardness in comparison to other materials. Different overlapping hardness scales are used to measure hardness based on the type of material being measured. For example, there are three overlapping numerical Shore scales (Shore 00, Shore A and Shore D) that can be used to measure the durometers of soft, medium and hard materials. Similarly, there are several Rockwell scales, including Rockwell M and Rockwell R, which can be used for measuring materials based on their hardness. All of the scales have conversion factors that allow those skilled in the art to convert a hardness value on one scale to a hardness value on another scale. A high numerical scale value indicates a hard material. The invention can be practiced using any one of the scales or using two of the scales and converting one of the scales.

As used herein, the term "flexural modulus" refers to the "stiffness" of a material when flexed, particularly a plastic, and is a measure of how a certain material will strain and potentially even deform when weight or force is applied to it. The flexural modulus is measured in Pascals (MPa or GPa) for the metric system or kilopound per square inch (ksi) for the English system.

As used herein, the term "pawl" refers to one or more pivoted members that are preferably curved and extend from the side of the passage through the cable tie head. The distal end of the pawl engages the teeth/ridges of a cable tie tail so that the tail can only move through the passage in one direction.

Cable ties of the present invention are typically molded from formulations that include plastic materials such as polyamide or polycarbonate resins. Different types of nylon have been found to be preferable, although polypropylene, polyethylene and other plastics, as well as combinations thereof can be used. In addition, varying amounts of colorants and processing additives can be included. The present invention uses two materials with different flexural moduli and hardnesses to form the head. The material that forms the outside portion of the head is stiffer and can also be harder than the material that is on the inside. The flexural modulus is more relevant to the design of the locking mechanism inside the cable tie head than the hardness.

The hardness of the two materials used in the cable tie head is determined using any one of several hardness scales that are well known to those skilled in the art. For example, using the Shore D hardness scale, low density polyethylene (LDPE) has a durometer of 40-50, high density polyethylene (HDPE) has a hardness of 60-70, polypropylene (PP) has a durometer of 70-80, nylon 6,6 has a durometer of 80-95 and various acrylics and phenolics have a durometer greater than 100. Using the Rockwell M hardness scale for molding grade plastics, the hardness for unfilled polyamide 6,6 is about 58-64, for polyamide 6,6 with 40% long glass fiber reinforcement is about 181 to 200, for regular polypropylene copolymer is about 55 to 62, for low density polyethylene is about 29 to 31, for high density polyethylene is about 31 to 35, for unfilled liquid crystal polymer (LCP) is about 62 to 68, for LCP with 50% glass fiber reinforcement is about 88 to 97, for high viscosity polycarbonate is about 70 to 75. Similarly, the Rockwell R hardness scale can be used and exemplary hardness values are: 33 to 66 for high density polyethylene; 80 to 102 for homopolymer polypropylene; 65 to 96 for copolymer polypropylene; 78 to 121 for unreinforced nylon 6,6; 72 to 123 for polycarbonate; and 71 to 120 for polystyrene. Some of the softer elastomers may fall outside the range of the Rockwell R scale.

The hardness scales (any of the Shore or Rockwell scales) are absolute values and do not have dimensions. They are a relative measure of the hardness of one material versus other materials. The present invention is not limited in any way by the hardness scale that is used to measure the hardness of the two materials that are used in the cable tie head. Any scale can be used as long as the difference between the hardness of the two materials is at least 5, preferably at least 10 and more preferably at least 15.

The stiffness of the two materials used in the cable tie head is determined using the flexural modulus values that are well known to those skilled in the art. For example, unfilled nylon 6,6 has a flexural modulus of about 1.5 GPa, glass fiber reinforced nylon 6,6 can have a flexural modulus as high as 28 GPa, unfilled polypropylene has a flexural modulus of about 1.2 GPa, unfilled low density polyethylene has a flexural modulus of about 0.025 GPa, unfilled polycarbonate has a flexural modulus of about 2.3 GPa, unfilled liquid crystal polymer has a flexural modulus of about 10 GPa, and glass fiber reinforced liquid crystal polymer can have a flexural modulus as high as 19 GPa.

The cable ties have a locking mechanism at one end that engages the opposing end to form a loop. The mechanical operation of various locking mechanisms is well known to those skilled in the art. In preferred embodiments of the present invention, the locking mechanisms are designed for a single use. Once the locking mechanism is engaged, it cannot be opened without visibly damaging it. This allows any tampering to be easily detected.

Figure 2:
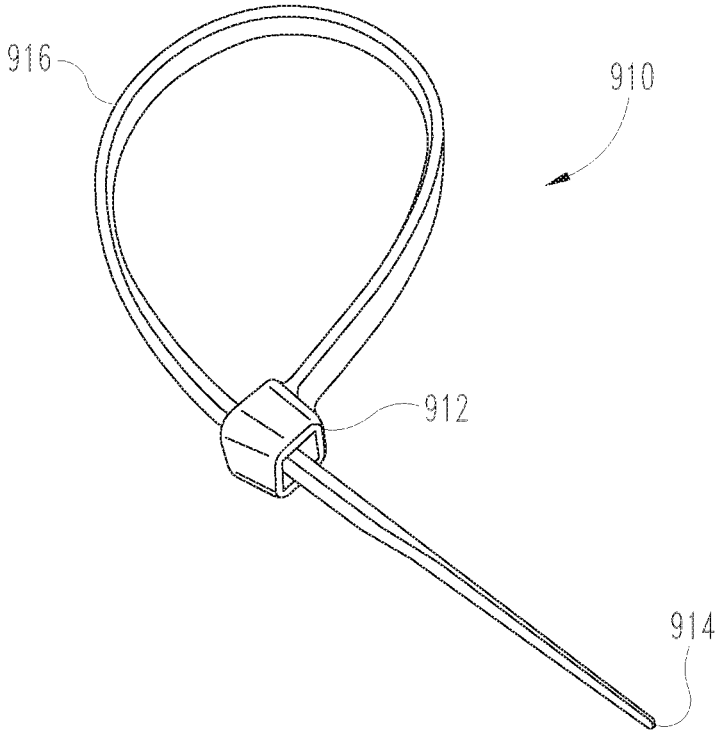
Fig. 2 (Prior Art)
FIG. 2 is a prior art cable tie in a locked configuration.
Figure 3:
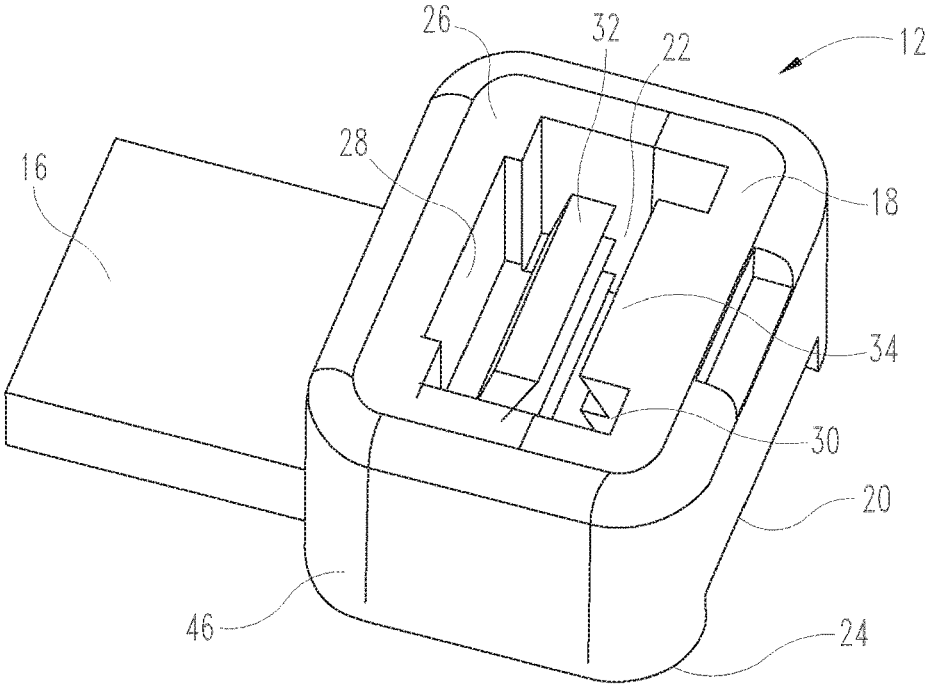
FIG. 3 is a top peripheral view of an embodiment of the cable tie of the present invention showing the outlet side of the head with a passage and a pawl on one side of the passage and fixed teeth on the opposing side.
Figure 4:
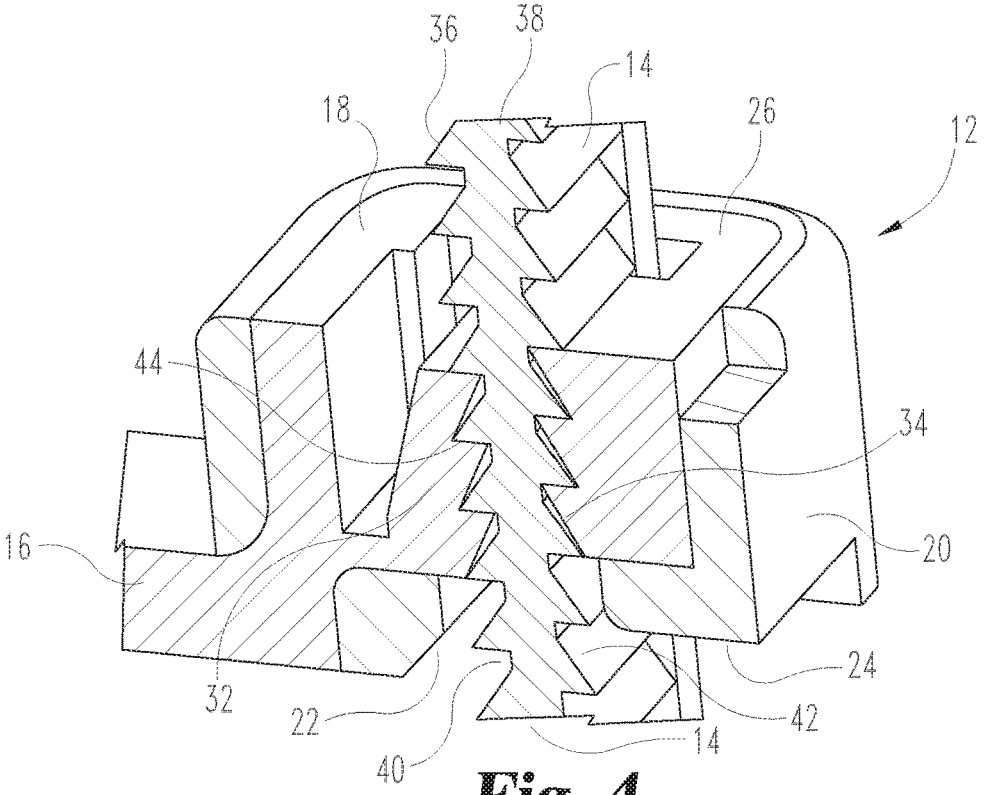
FIG. 4 is a cross-sectional view of the cable tie head shown in FIG. 3 with a cable tie tail secured in the head.

Referring now to the drawings, FIGS. 3-6 show an embodiment of the cable tie 10 of the present invention. The configuration of the cable tie 10 of the present invention is similar to the prior art cable ties 910 shown in FIGS. 1 and 2. The cable tie 10 of the present invention has a strap 16 connecting a head 12 and a tail 14. However, the present cable tie 10 is significantly different from prior art cable ties 910 with respect to the dual material head 12 and the double-sided teeth/ridges 40, 42 on the surfaces 36, 38 of the tail 14. FIGS. 3-6 are directed to a preferred embodiment of the cable tie 10 of the present invention and show the strap 16 connected to the head 12. The head 12 has a first (or inner) portion 18, a second (or outer) portion 20 and a passage 22 that extends through the head 12 from a first end 24 to a second end 26. The passage 22 has a first side 28 and a second side 30 with a pawl 32 extending from the first side 28 and a plurality of fixed teeth 34 extending from the second side 30. FIG. 3 shows the head 12 before the tail 14 is inserted and FIG. 4 shows the head 12 after the tail 14 is inserted. In FIGS. 3-6, inner portion 18 of the head 12, including the pawl 32 and fixed teeth 34, are made of the same material as the strap 16. The outer portion 20 of the head 12 is made from a different material that is stiffer and can be also harder than the inner portion 18. The outer portion 20 prevents the inner portion 18 from moving outwardly and thus makes the head 12 more rigid.

FIG. 4 shows a cable tie tail 14 secured in the head 12. The cable tie tail 14 has first and second sides 36, 38 with teeth/ridges 40, 42 on both sides 36, 38. The teeth 40 on the first side 36 engage the teeth 44 on the pawl 32 and the teeth 42 on the second side 38 engage the fixed teeth 34 that extend from the second wall 30 of the passage 22. FIG. 4 also shows how the tail 14 is inserted in the passage 22 from the first end 24 of the head 12 and passes through the head 12 because the teeth 40, 42 on the tail 14 and the teeth 44 on the pawl 32 and the fixed teeth 34 are all slanted in the same direction. However, if the user attempts to withdraw the tail 14 from the head 12, the teeth 40, 42 on the tail 14 engage the teeth 44 on the pawl 32 and fixed teeth 34 and prevent the tail 14 from being removed from the head 12.

Figure 5:
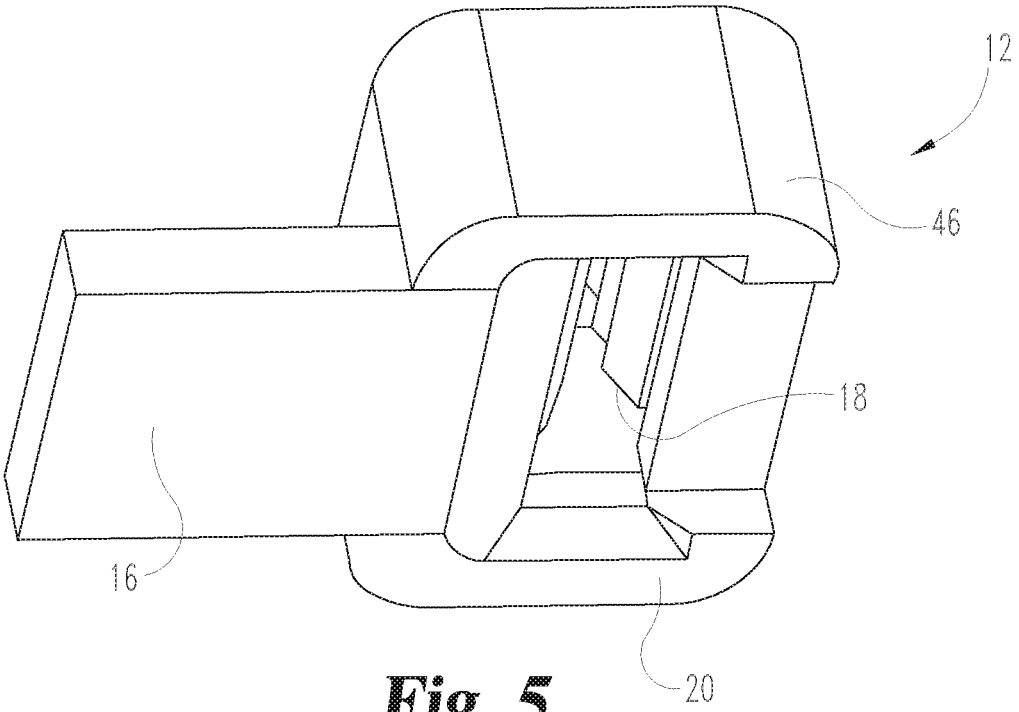
FIG. 5 is a bottom peripheral view of the cable tie head shown in FIG. 3.
Figure 6:
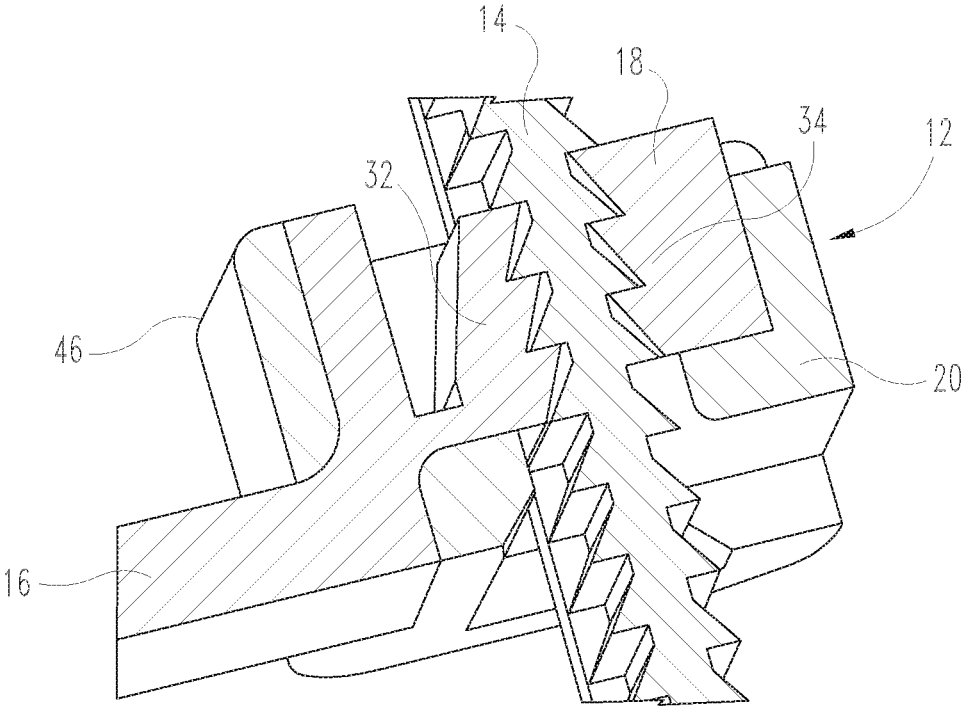
FIG. 6 is a cross-sectional view of the cable tie head shown in FIG. 3 with a cable tie tail secured in the head.

FIGS. 3 and 5 show how the second portion 20 of the head 12 forms an outer wall 46 around the inner portion 18 on the sides of the head 12. FIG. 6 illustrates how an attempt to withdraw the tail 14 from the head 12 exerts and outward force on the inner portion 18 that is resisted by the stiffer and/or harder material of the outer portion 20. The stiffer and/or harder material of the outer portion 20 of the head 12 makes it more difficult to remove the tail 14 from the head 12 than it would be if the entire head 12 was formed of the same material.

Figure 7:
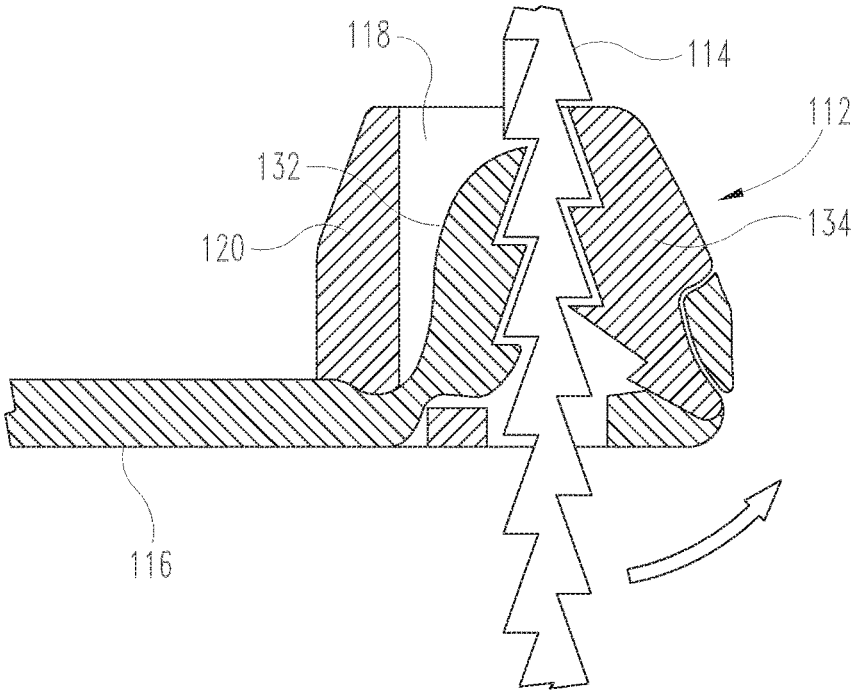
FIG. 7 is a side cross-sectional view a second embodiment of the cable tie head with teeth extending from the hard material on one side of the cable tie head opposite the pawl.

FIG. 7 shows another embodiment of the cable tie head 112 with fixed teeth 134 formed from the stiff and hard material of the second portion 20 of the head 112 opposite the pawl 132. Forming the fixed teeth 134 of a stiffer and/or harder material engages the tail 114 in the head 112 more securely and increase the amount of force required for the user to withdraw the tail 114 form the head 112.

Figure 8:
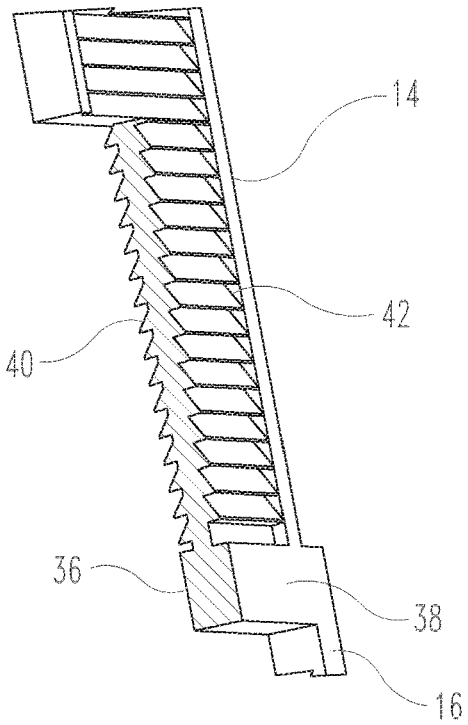
FIG. 8 is a cross-sectional, peripheral side view of the tail of the cable tie with teeth/ridges on both sides.

FIG. 8 shows a cable tie tail 14 with teeth/ridges 40, 42 on the surfaces of both sides 136, 138. Typical prior art cable ties only have teeth/ridges on one side.

Figure 9:
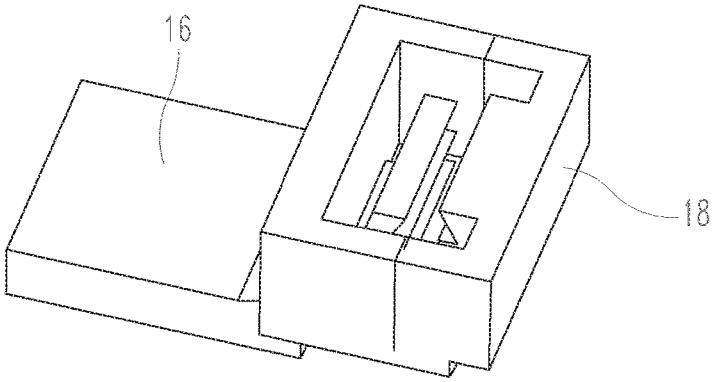
FIG. 9 is peripheral side view of the strap and first portion of the head of the cable tie.
Figure 10:
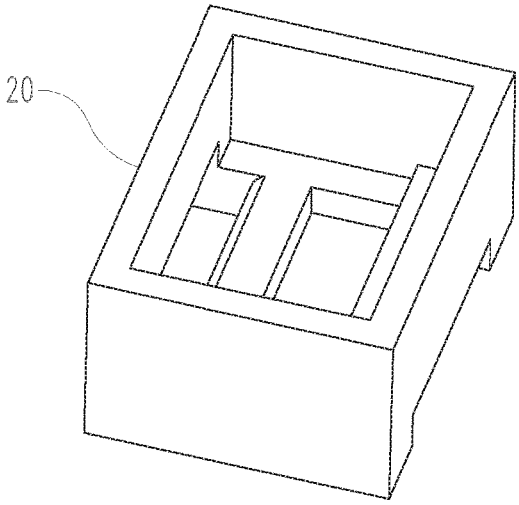
FIG. 10 is a, peripheral side view of the second portion of the head of the cable tie.
Figure 11:
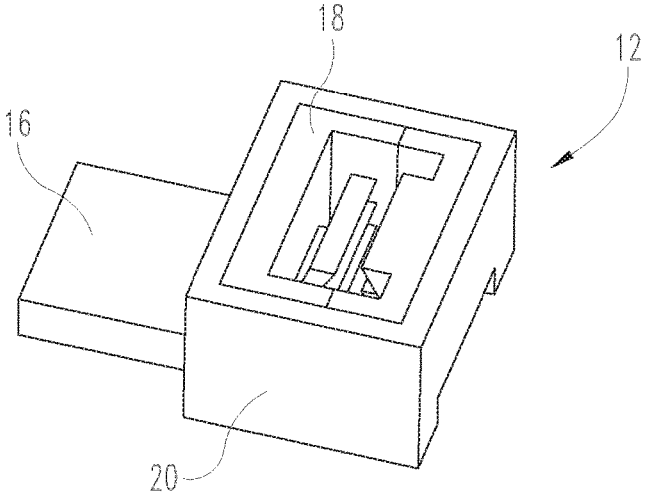
FIG. 11 is a peripheral side view of the first portion of the head of the cable tie shown in FIG. 9 inserted in the second portion of the head shown in FIG. 10.

FIGS. 9-11 show how the cable tie 10 of the present invention is formed. FIG. 9 shows the cable tie strap 16 and first portion 18 of the head 12 that are formed by a first process, such as casting or injection molding. FIG. 10 shows the second portion 20 of the head 12 that is formed by a second process, which can also be casting or molding. FIG. 11 shows how the first portion 18 of the head 12 is inserted into the second portion 20 to form the dual material cable tie head 12 of the present invention.

Figure 12:
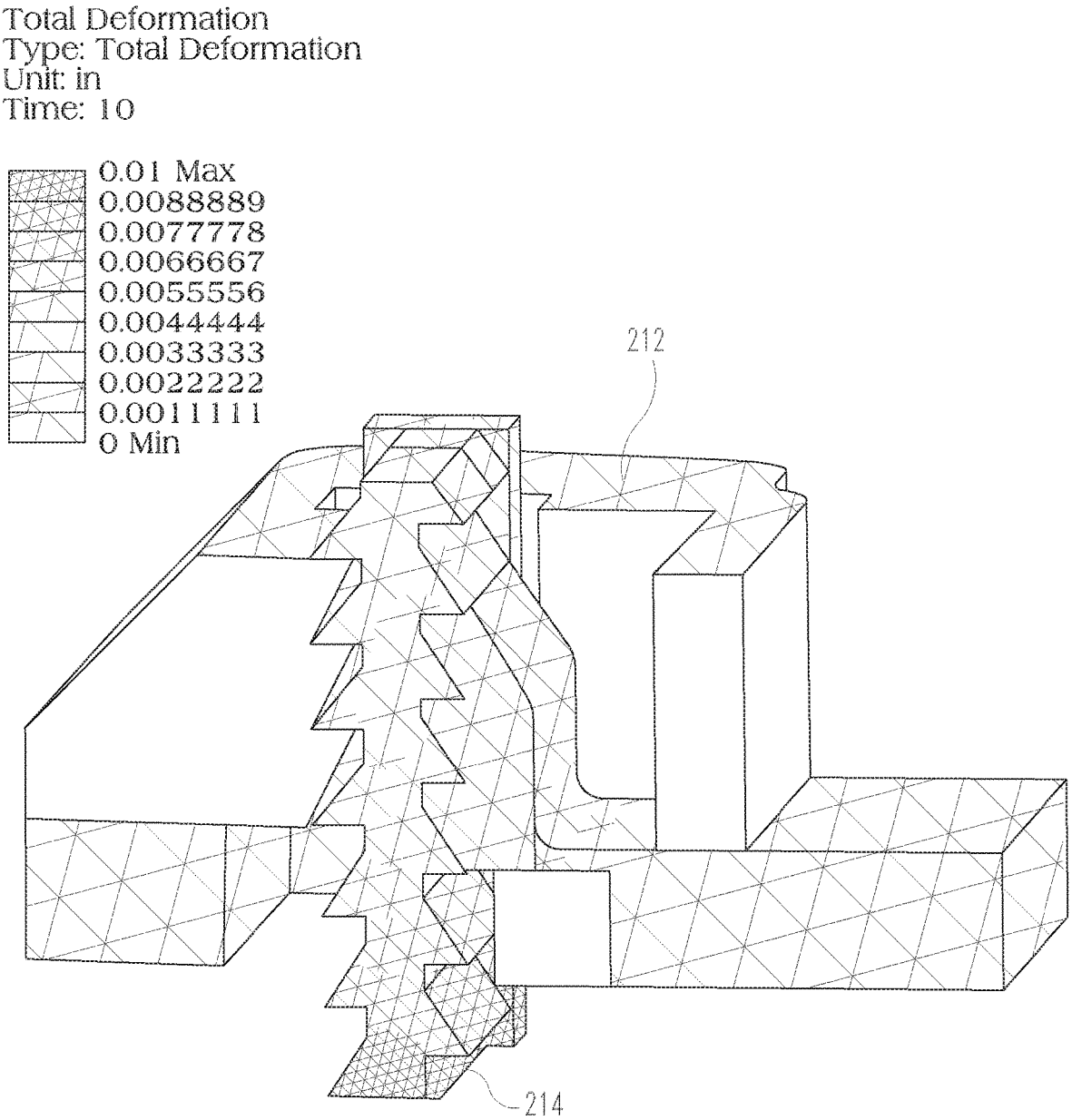
FIG. 12 is a graphical illustration showing the deformation that occurs when a cable tie tail secured in a cable tie head of the present invention is withdrawn.

FIG. 12 is a graphical illustration showing the deformation when a user attempts to withdraw a cable tie tail 214 is secured in the cable tie head 212 of the present invention.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A dual material cable tie comprising:

a tail formed from a first material and located at a first end of the cable tie;

a head located at a second end of the cable tie and having a passage extending from a first end of the head to a second end of the head for receiving the tail, the head including a first portion, a second portion, and a pawl located on the first portion, wherein the second portion comprises an exterior surface of the head and allows the tail to extend outwardly from the first and second ends of the head; and a strap formed from the first material and extending between the tail and the head, wherein the first portion of the head including the pawl is made from the first material and the second portion of the head is made from a second material, and wherein the second material is stiffer and/or harder than the first material.

2. The dual material cable tie according to claim 1, wherein the first material has a maximum durometer and the second material has a minimum durometer that is at least 10 on the Shore D scale greater than the maximum durometer of the first material.

3. The dual material cable tie according to claim 1, wherein the tail is substantially flat and has opposing first and second surfaces, and wherein the opposing surfaces each have a plurality of teeth extending outwardly.

4. The dual material cable tie according to claim 1, wherein the passage is defined by first and second sides that extend between the first and second ends, and wherein the pawl extends from the first side.

5. The dual material cable tie according to claim 4, wherein the second side of the passage has one or more teeth extending into the passage.

6. The dual material cable tie according to claim 5, wherein the second side of the passage is formed from the second material.

7. The dual material cable tie according to claim 6, wherein the tail is substantially flat and integrally formed with the strap and has opposing first and second surfaces, and wherein the opposing surfaces each have a plurality of teeth extending outwardly.

8. The dual material cable tie according to claim 7, wherein the teeth extend obliquely from the second side of the passage towards the second end of the head, wherein each of the plurality of teeth on the opposing surfaces of the tail extend obliquely away from the first end of the cable tie, wherein the tail end of the cable tie passes freely in a direction between the first end and the second end of the head, and wherein the teeth in the passage engage the teeth on the opposing surfaces of the tail to prevent the tail of the cable tie from passing freely in the direction between the second end and the first end of the head.

9. The dual material cable tie according to claim 1, wherein the tail, the strap, and the first portion of the head are integrally formed by a first process and the second portion of the head is formed by a second process.

10. The dual material cable tie according to claim 9, wherein the second process is an over-molding process.

11. The dual material cable tie according to claim 9, wherein the first and second processes are performed independently and the cable tie head is assembled by inserting the first portion into the second portion.

12. A dual material cable tie comprising:

a tail formed from a first material and located at a first end of the cable tie;

a head located at a second end of the cable tie and having a passage extending from a first end of the head to a second end of the head for receiving the tail, the head including a first portion, a second portion, and a pawl located on the first portion, wherein the second portion comprises an exterior surface of the head and allows the tail to extend outwardly from the first and second ends of the head; and a strap formed from the first material and extending between the tail and the head, wherein the first portion of the head including the pawl is made from the first material and the second portion of the head is made from a second material, and wherein the first material has a maximum durometer and the second material has a minimum durometer that is at least 10 on the Shore D scale greater than the maximum durometer of the first material.

13. The dual material cable tie according to claim 12, wherein the tail is substantially flat and has opposing first and second surfaces, and wherein the opposing surfaces each have a plurality of teeth extending outwardly.

14. The dual material cable tie according to claim 12, wherein the passage is defined by first and second sides that extend between the first and second ends, and wherein the pawl extends from the first side.

15. The dual material cable tie according to claim 14, wherein the second side of the passage has one or more teeth extending into the passage.

16. The dual material cable tie according to claim 15, wherein the second side of the passage is formed from the second material.

17. The dual material cable tie according to claim 16, wherein the tail is substantially flat and integrally formed with the strap and has opposing first and second surfaces, and wherein the opposing surfaces each have a plurality of teeth extending outwardly.

18. The dual material cable tie according to claim 17, wherein the teeth extend obliquely from the second side of the passage towards the second end of the head, wherein each of the plurality of teeth on the opposing surfaces of the tail extend obliquely away from the first end of the cable tie, wherein the tail end of the cable tie passes freely in a direction between the first end and the second end of the head, and wherein the teeth in the passage engage the teeth on the opposing surfaces of the tail to prevent the tail of the cable tie from passing freely in the direction between the second end and the first end of the head.

19. The dual material cable tie according to claim 12, wherein the tail, the strap, and the first portion of the head are integrally formed by a first process and the second portion of the head is formed by a second process, and wherein the second process is an over-molding process.

20. The dual material cable tie according to claim 19, wherein the first and second processes are performed independently and the cable tie head is assembled by inserting the first portion into the second portion.

* * * * *